US005950400A

United States Patent [19]

Callahan

[11] Patent Number: 5,950,400

[45] Date of Patent: Sep. 14, 1999

[54] APPARATUS AND METHOD FOR PROTECTING ROLLED MATERIAL

[75] Inventor: W. Scott Callahan, Coraopolis, Pa.

[73] Assignee: C & S Associates, Coraopolis, Pa.

[21] Appl. No.: 08/742,091

[22] Filed: Oct. 31, 1996

[51] Int. Cl.[6] ..... B65B 11/00

[52] U.S. Cl. ..... 53/410; 53/462

[58] Field of Search ..... 53/410, 441, 461, 53/462, 465; 206/395, 410, 413, 414, 415, 416

[56] References Cited

U.S. PATENT DOCUMENTS

| | | | |
|---|---|---|---|
| D. 347,567 | 6/1994 | Duffy . | |
| 1,351,809 | 9/1920 | Sutherland . | |
| 1,603,959 | 10/1926 | Leven | 206/413 |
| 1,612,262 | 12/1926 | Coggins et al. . | |
| 1,689,430 | 10/1928 | Gwinn . | |
| 1,714,532 | 5/1929 | Walter . | |
| 1,871,765 | 8/1932 | Williamson . | |
| 1,989,183 | 1/1935 | Blake | 206/414 |
| 2,368,213 | 1/1945 | Gerlach . | |
| 2,803,935 | 8/1957 | Gibson . | |
| 2,883,045 | 4/1959 | Abramson . | |
| 2,893,189 | 7/1959 | Lancaster . | |
| 3,710,539 | 1/1973 | Cothran et al. . | |
| 3,750,361 | 8/1973 | Stevens . | |
| 3,760,156 | 9/1973 | Konger . | |
| 3,837,480 | 9/1974 | Brunett | 206/416 X |
| 3,867,806 | 2/1975 | Lancaster, III et al. . | |
| 3,875,723 | 4/1975 | Sundin . | |
| 3,995,409 | 12/1976 | Discavage et al. . | |
| 4,077,179 | 3/1978 | Lancaster et al. . | |
| 4,137,690 | 2/1979 | Morgan . | |
| 4,201,028 | 5/1980 | Melehan . | |
| 4,244,471 | 1/1981 | Plante . | |
| 4,524,562 | 6/1985 | Yagi et al. . | |
| 4,528,802 | 7/1985 | Salzmann . | |
| 4,534,151 | 8/1985 | Schneck et al. . | |
| 4,565,049 | 1/1986 | DeLigt et al. . | |
| 4,666,536 | 5/1987 | Van Erden et al. . | |
| 4,677,728 | 7/1987 | Straus . | |
| 4,744,198 | 5/1988 | Hood et al. . | |
| 4,782,645 | 11/1988 | Tajima et al. . | |
| 4,884,385 | 12/1989 | Mushinski et al. . | |
| 4,912,820 | 4/1990 | Bregier . | |
| 4,995,512 | 2/1991 | Liebel . | |
| 5,046,298 | 9/1991 | Norkoski et al. . | |
| 5,143,775 | 9/1992 | Olsson et al. . | |
| 5,226,280 | 7/1993 | Scherer et al. . | |
| 5,351,825 | 10/1994 | Duffy . | |
| 5,392,585 | 2/1995 | Wall . | |

FOREIGN PATENT DOCUMENTS

| | | |
|---|---|---|
| 2838862 | 3/1979 | Germany . |
| 4405187 | 9/1994 | Germany . |
| 398812 | 4/1991 | Japan . |
| 4327112 | 11/1992 | Japan . |

*Primary Examiner*—Jacob K. Ackun
*Attorney, Agent, or Firm*—Thorp, Reed & Armstrong

[57] ABSTRACT

An end cap for protecting industrial rolled products having a plurality of concentric scored lines inwardly spaced from the periphery of the end cap which allow the end cap to conform to metal coils of various diameters. Additionally, the end cap defines a plurality of radially extending, arcuate gaps disposed around the periphery of the end cap and extend from the scored lines to the periphery of the end cap which allows the end cap to conform to the side of the metal coil without overlapping.

A method for protecting rolled products comprises the steps of positioning an end cap proximate to the edge of a rolled product and stretch wrapping a sheet material over the end cap and edge to secure the end cap thereon.

8 Claims, 5 Drawing Sheets

APPARATUS AND METHOD FOR PROTECTING ROLLED MATERIAL

FIELD OF THE INVENTION

The present invention relates to apparatus and methods for protecting industrial rolled products, namely metal coils. More particularly, the present invention relates to an end cap which readily conforms to edges of such coils having diameters of various sizes and to methods for mounting the end caps onto metal coils.

BACKGROUND OF THE INVENTION

Sheet metal as it comes off of a rolling mill is usually wound onto hollow cylindrical mandrels so that the sheet metal can be conveniently handled, shipped, and unrolled when the metal is ultimately used. During shipping and handling, however, the metal coil is subject to edge damage or exposure to dirt, water, and other corrosive elements. Furthermore, the exposed side edges of the sheet forming the roll or coil are often sharp and, therefore, may injure persons or objects coming into contact therewith.

Several patents disclose various apparatus for protecting the end surfaces of coiled industrial products. Of these patents, U.S. Pat. No. 5,392,585 to Wall discloses rolled paper wrapping apparatus employing roll headers and end wrap paper defining v-shaped notches at the edges thereof to prevent the end wrap paper from forming ridges when overlapped on the end of the rolled paper, thereby preventing ridge-induced indentations in the ends of the rolled paper. U.S. Pat. No. 2,883,045 to Abramson discloses a circular cover sheet for a metal coil having inner and outer circular bands of adhesive material, each of which has a plurality of circumferentially spaced, radial slits.

U.S. Pat. No. 4,677,728 to Straus discloses a roll edge protector comprising a leg integrally formed at a right angle to a scalloped webbing. The leg can be wrapped on the sides of the coil so that the webbing extends over the edges of the coil. The roll edge protector of Straus, however, does not protect the entire edge of a coil.

U.S. Pat. No. 4,201,028 to Melehan discloses an apparatus for applying end caps having pluralities of circumferentially spaced radial slits onto rolled sheet stock. The end caps are forced by hydraulic forming assemblies of the Melehan apparatus onto the ends of the rolled sheet stock.

U.S. Pat. No. 1,871,765 to Williamson discloses a machine for packaging pie plates and similar articles which employs automated presser members and folding jaws to press and form circular paper disks having pluralities of circumferentially spaced v-shaped notches onto the ends of a cylindrical package of pre-wrapped pie plates.

None of the known apparatus, however, provide for an end cap which readily conforms to the edges and sides of coiled material of various diameters to protect the edge and peripheral side of the coil. Furthermore, none of the known methods for protecting coiled products provide for the installation of an end cap adaptable to coils of various sizes, with or without the use of adhesives.

Consequently, it is desirable to provide an end cap which readily conforms to the edges and sides of rolls of coiled material of various diameters.

It is also desirable to provide an end cap for a metal coil comprising either a light weight or a heavy weight corrugated material. Furthermore, it would be desirable to provide an end cap which is relatively inexpensive and easily manufactured.

It would also be desirable to provide a method for installing an end cap which easily conforms to the edges and sides of coils having various diameters.

SUMMARY OF THE INVENTION

The present invention relates to an end cap which protects the end surfaces of coiled industrial products, particularly metal coils. The end cap protects the edges and part of the sides of the metal coil against corrosion and other damaging effects of the environment, shipping and handling.

The end cap of the present invention comprises a generally circular corrugated body having, preferably, a number of concentric scored or perforated lines inwardly spaced from the periphery of the body. The variably spaced scored lines allow the end cap to conform to metal coils having outer diameters of various sizes. Additionally, radial, arcuate gaps are disposed around the circumference of the body, and preferably extend from the scored lines to the periphery of the body.

A preferred method according to the present invention for installing the end cap comprises the steps of: (a) positioning an end cap of the present invention on an end of the metal coil and (b) applying a stretch wrap to that end of the coil to seal the end cap onto the coil. The tightly applied stretch wrap causes the end caps to bend at the scored or perforated lines to conform to the shape of the outer diameter of the coil and to fold over the edge thereof. Additionally, the application of a stretch wrap causes the annular skirt having die cut, arcuate radial gaps to collapse against the side of the metal coil without overlapping. In this manner, the end cap readily conforms to the sides and edges of the coil thereby providing more thorough protection for the same.

These and other objects, features, and advantages of the present invention will become apparent from the following detailed description of the presently preferred embodiments of practicing the invention.

BRIEF DESCRIPTION OF THE DRAWINGS

In the accompanying drawings, preferred embodiments of the invention and preferred methods of practicing the invention are illustrated in which.

DETAILED DESCRIPTION OF THE PREFERRED EMBODIMENT

Figure 1:
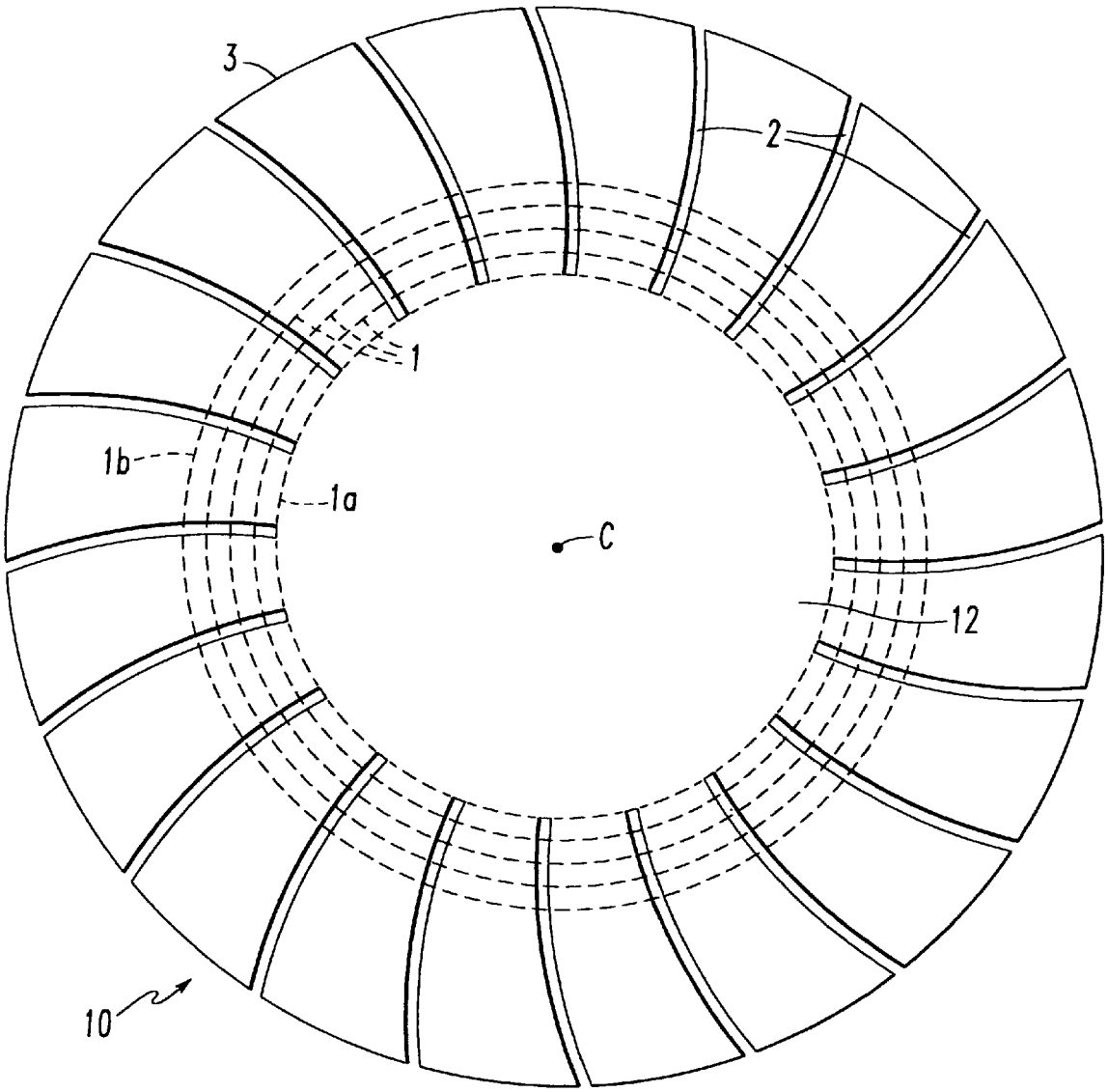
FIG. 1 is a top plan view of a preferred embodiment of the end cap of the present invention.
Figure 2:
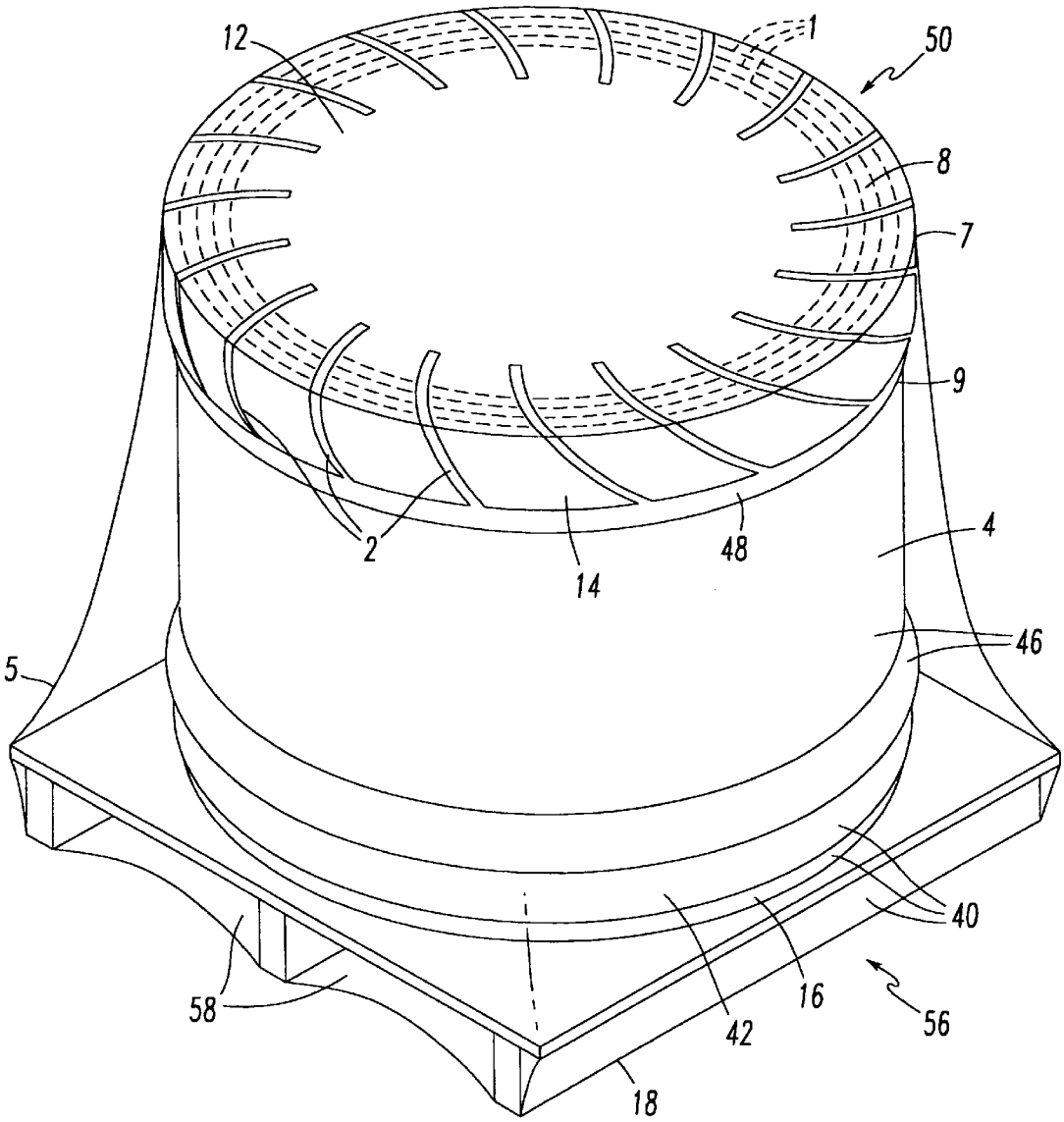
FIG. 2 is a view of a preferred end cap applied to a metal coil according to the method of the present invention.
Figure 3:
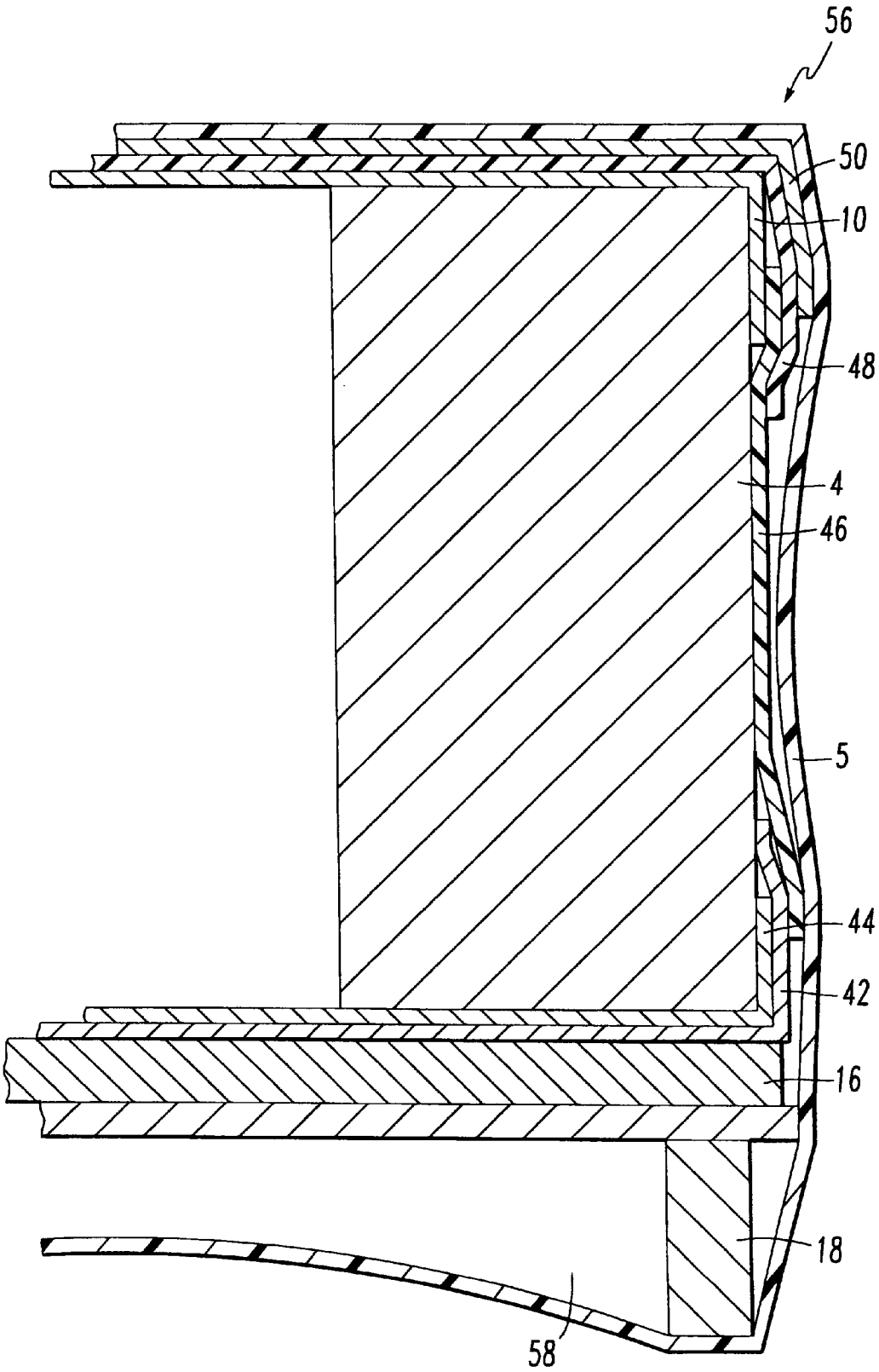
FIG. 3 is a partial cross-sectional view of a rolled material protected according to the method of the present invention.

As shown in FIGS. 1 and 2, the present invention provides for an end cap 10 preferably comprising a generally circular body 12 having a center C and made from corrugated paper board which completely covers the end surface 8 of a cylindrical coil 4. Although the end cap 10 of the present invention may be used to protect any type of rolled material, it is preferably used to protect coils of metal including brass, copper, aluminum, steel and the like.

Scored lines 1 and radial gaps 2 allow end cap 10 to conform to the ends 8 of the cylindrical coil 4. Preferably, the coil 4 and end cap 10 are stretched-wrapped with plastic sheeting which is preferably polyethylene of 2 millimeter (mil) thickness. The polyethylene stretch wrap may also preferably be impregnated with a volatile, corrosive-inhibiting liquid (VCIL) to further protect the coil 4 against corrosion. Upon the application of stretch wrap 5, the scored lines 1 allow the end cap 10 to fold over the edge 7 of the coil 4, while the radial gaps 2 allow the end cap 10 to conform to the peripheral side 9 of the coil 4 without overlapping as shown in FIG. 2.

In the following description and the accompanying drawings, only one end surface 8 of the metal coil 4 and end cap 10 are described and shown. Both end surfaces 8 of the coil 4, however, may be similarly covered by an end cap 10 and stretch-wrapped.

Generally, the end cap 10 of the present invention has at least one circular scored or perforated line 1 inwardly spaced from the periphery 3 of the end cap 10. The scored line 1 allows the end cap 10 to be readily folded over the edge 7 of the coil 4. In a preferred embodiment of the present invention, a plurality of concentric scored lines 1 are inwardly spaced from the periphery 3 of the end cap 10 so that the end cap 10 may conform to metal coils having various outer diameters. The most inwardly spaced, annular scored line is identified as 1*a*, while the most outwardly spaced, annular scored line is identified as 1*b*. Each individual perforation of the concentric scored lines is preferably ¼ inch in width by ¼ inch in depth, thereby providing for sufficient bendability of the corrugated material.

The annularly spaced gaps 2 of the present invention are preferably curved and extend radially from the periphery 3 of the end cap 10 to the inner most scored line 1*a*. Each radial gap 2 is preferably cut by two blades of a punch or die used to make the end cap 10, including scored lines 1.

Figure 4:
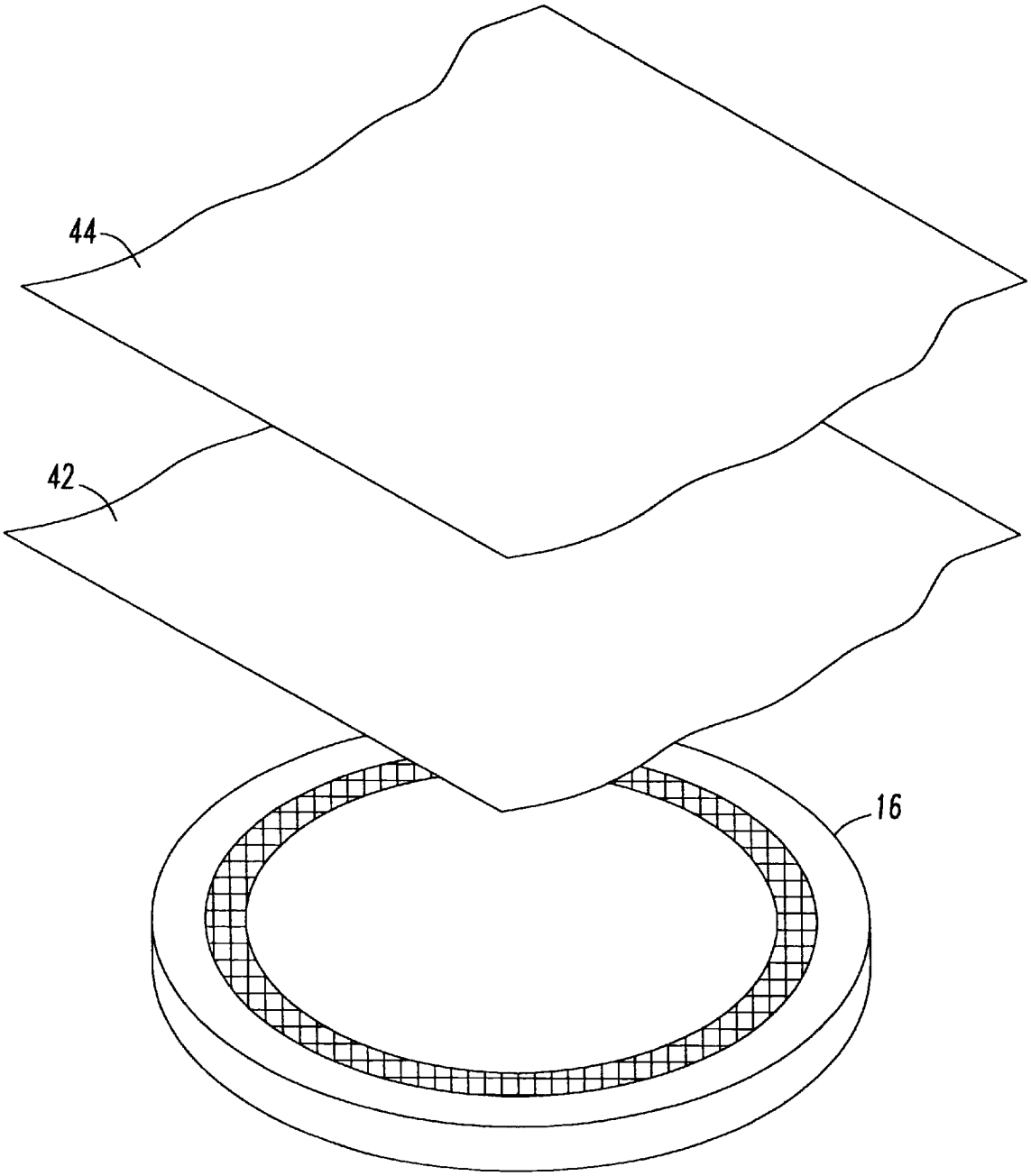
FIG. 4 is an exploded, perspective view of the deck pad, middle sheet and top sheet used in accordance with the method of the present invention.
Figure 5:
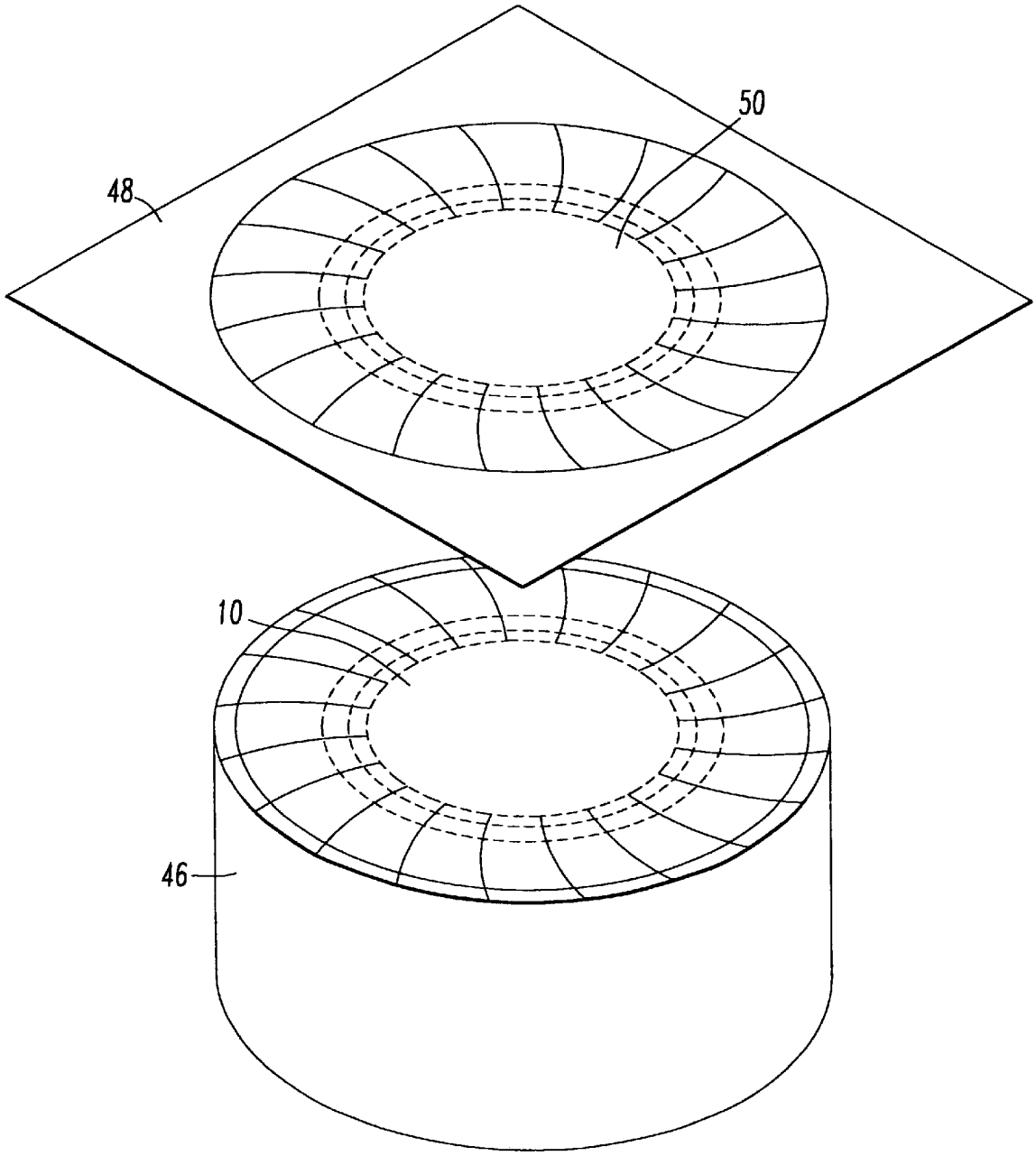
FIG. 5 is an exploded perspective view of the end caps, skirt and cover sheet used in accordance with the method of the present invention.

As shown in FIGS. 2–5, a preferred method for protecting a coil according to the present invention comprises the steps of:

(1) Positioning the coil 4 vertically with respect to the longitudinal axis thereof onto an assembly 40 disposed on pallet 18 and comprising a deck pad 16, and elastomeric middle sheet 42 and top sheet 44. The deck pad 16 is preferably circular in shape and made from needled fiber, such as cotton, or polyethylene foam. The middle sheet 42 preferably comprises polyethylene or polypropylene sheeting and is preferably attached to the deck pad 16 with a pressure sensitive hot melt adhesive. The top sheet 44 preferably comprises spun-bounded polypropylene sheeting disposed between two plies of polyethylene sheeting. The top sheet 44 is also preferably treated with a VCIL on its upper side to further protect the coil 4 from corrosion. As shown in FIG. 4, the middle sheet 42 has a larger area than either the deck pad 16 or the top sheet 44. Such dimensions allow the middle sheet 42 to be pulled up around the peripheral side 9 where it can be affixed to the coil 4 with tape or other suitable adhesives.

(2) Positioning a first end cap 10 on the top edge 7 of the coil 4.

(3) Affixing, with tape or other suitable adhesives preferably pressure sensitive hot melt adhesive, a coil skirt 46, preferably made from an elastomeric material such as polyethylene or polypropylene, which may be spun-bounded or woven, around the periphery of the first end cap 10 such that the coil skirt 46 overlaps the periphery of the first end cap 10 by about 4–6 inches and such that the coil skirt 46 drapes down and surrounds the coil 4.

(4) Spraying or otherwise applying a VCIL onto the first end cap 10 and coil skirt 46.

(5) Affixing, with tape or other suitable adhesives, preferably a pressure sensitive hot melt adhesive, a cover sheet 48, preferably made from an elastomeric material such as polyethylene, onto the portion of the coil skirt 46 which overlaps the first end cap 10 such that the cover sheet 48 covers the first end cap 10 and drapes down and overlaps a portion of the coil skirt 46.

(6) Affixing a second end cap 50 to the cover sheet 48 with an adhesive material, preferably in pressure sensitive hot melt adhesive, so that the second end cap 50 is concentric with the first end cap 10 and so that both end caps are centered on top of the edge 7 of the coil 4.

(7) Stretch wrapping the package assembly 56 comprising the pallet 18, middle sheet 42, top sheet 44, coil 4, first end cap 10 with coil skirt 46, cover sheet 48 and second end cap 50 with polyethylene sheeting 5, which may also be preferably impregnated with a VCIL. The package assembly 56 is preferably stretched wrapped in such a manner that the slots 58 defined by the bottom of the pallet 18 remain open so that the package assembly 56 can be handled by conventional fork lifts.

As described above, the stretch wrapping step causes the first and second end caps 10 and 50, respectively, to bend along the appropriate scored lines 1 to conform to the edge 7 and peripheral side 9 of the coil 4, thereby providing maximum protection therefor.

An apparatus useful for stretch wrapping coils supported on pallets is available from Liberty Industries of Girard, Ohio.

Although the invention has been described in detail in the foregoing for the purpose of illustration, it is to be understood that such detail is solely for that purpose and that variations can be made therein by those of ordinary skill in the art without departing from the spirit and the scope of the invention as defined by the following claims, including all equivalents thereof.

I claim:

1. A method for wrapping rolled material comprising the steps of:

(a) positioning the rolled material vertically with respect to a longitudinal axis thereof onto an assembly comprising a pallet, a deck pad, a middle sheet and a top sheet;

(b) attaching the middle sheet to the rolled material so that the middle sheet covers a portion of the rolled material;

(c) positioning a first end cap in proximity with an upper edge of the rolled material, the first end cap comprising at least one ring of perforations and a plurality of curved, radial gaps extending inwardly from, and spaced about the periphery of said first end cap;

(d) attaching a skirt around the periphery of the first end cap so that the skirt surrounds a portion of the rolled material;

(e) attaching a cover sheet to the first end cap so that the cover sheet covers the first end cap and a portion of the rolled material;

(f) positioning a second end cap over the cover sheet concentrically with the first end cap, the second end cap comprising at least one ring of perforations and a plurality of curved, radial gaps extending inwardly from, and spaced about the periphery of said second end cap; and (g) stretching sheet material over the second end cap, rolled material and assembly so that the first and second end caps bend over the upper edge of the rolled material along said perforations and conform to the rolled material.

2. The method of claim 1 wherein the deck pad comprises needled fiber.

3. The method of claim 1 wherein the deck pad comprises polyethylene foam.

4. The method of claim 1 wherein the sheet material comprises polyethylene.

5. The method of claim 1 wherein the top sheet is treated with a volatile, corrosive-inhibiting liquid.

6. The method of claim 1 wherein the first end cap and skirt are treated with a volatile, corrosive-inhibiting liquid.

7. The method of claim 1 wherein the top sheet is disposed on top of the middle sheet.

8. The method of claim 7 wherein the middle sheet is larger than the top sheet, first end cap and skirt are treated with a volatile, corrosive-inhibiting liquid.

* * * * *